United States Patent [19]

Crescenzo et al.

[11] 4,346,545

[45] Aug. 31, 1982

[54] SEALING WHEEL FOR FORMING FIN SEAL PACKAGE

[75] Inventors: Francis C. Crescenzo, Springfield; Paul J. LaFleur, Jr., Wilbraham, both of Mass.

[73] Assignee: Package Machinery Company, East Longmeadow, Mass.

[21] Appl. No.: 107,174

[22] Filed: Dec. 26, 1979

[51] Int. Cl.[3] ..... B65B 11/28

[52] U.S. Cl. ..... 53/234; 53/373

[58] Field of Search ..... 53/225, 229, 234, 373, 53/206; 192/135

[56] References Cited

U.S. PATENT DOCUMENTS

| | | | |
|---|---|---|---|
| 1,352,221 | 9/1920 | Reifsnyder | 53/207 |
| 1,946,697 | 2/1934 | Johnson | 53/234 |
| 3,271,923 | 9/1966 | Fullbrook | 53/229 |
| 3,418,785 | 12/1968 | Duryee | 53/373 |
| 3,448,558 | 6/1969 | Hurtle | 53/373 |
| 3,987,605 | 10/1976 | Johnson | 53/234 |
| 4,020,608 | 5/1977 | Seragnoli | 53/234 |
| 4,073,123 | 2/1978 | Schoppee | 53/234 |
| 4,228,884 | 10/1980 | Michels | 192/135 |

*Primary Examiner*—John Sipos

*Attorney, Agent, or Firm*—McCormick, Paulding & Huber

[57] ABSTRACT

A sealing wheel having a plurality of radially outwardly opening pockets is rotatably indexed through loading and discharging positions. Each pocket, formed by a pair of stationary jaws, receives an article and its wrapper at the loading position and forms the wrapper to a U-fold about the article. Movable heat sealing jaws associated with each pair of stationary jaws have U-shaped sealing surfaces which engage marginal portions of the wrapper outwardly of the stationary jaws to form a U-shaped fin seal around three sides of the package, a fourth side being formed by the wrapper fold. A jaw opening mechanism opens each set of sealing jaws as it approaches the discharging position, where the wrapped and sealed package is ejected. The jaw opening mechanism is also arranged to simultaneously open all jaws in closed position in response to a predetermined condition, such as machine shut-down.

15 Claims, 11 Drawing Figures

SEALING WHEEL FOR FORMING FIN SEAL PACKAGE

BACKGROUND OF THE INVENTION

This invention relates in general to packaging machines and deals more particularly with an improved sealing wheel for forming a fin seal package. The machine of the present invention is particularly adapted to form a rectangular wrapper in a U-fold around an article or group of articles and seal three marginal edges of the wrapper in face-to-face relation to form a rectangular package characterized by a fin seal which extends along three side edges, the fourth side of the package being defined by a wrapper fold. Such a package is particularly suitable for containing gum or a like confection which requires a tightly sealed package for maximum product shelf life. Heretofore, reciprocating press type apparatus has been used to form packages of the aforedescribed type, however, such a press type sealing unit, which must operate on successive packages, cannot produce packages at an acceptable rate while remaining in engagement with each wrapper for a sufficient time to produce a seal of the integrity required for packaging perishable food products. The present invention is directed to this problem.

SUMMARY OF THE INVENTION

In accordance with the present invention, a sealing wheel comprises a wheel assembly and drive means for rotatably indexing wheel assembly through loading and packaging discharging positions. The wheel assembly includes a wheel body which has at least one radially outwardly opening pocket for receiving an article and its wrapper and forming the wrapper in a U-fold around the article. A pair of movable sealing jaws, which have opposing sealing surfaces, are supported on the wheel body in association with the pocket for movement between open and closed positions. The sealing surfaces of the jaws are engageable with marginal portions of the wrapper which extend outwardly beyond the confines of the pocket when the jaws are in closed position. A means is provided for heating at least one of the sealing surfaces. A means is also provided for opening and closing the sealing jaws.

DETAILED DESCRIPTION OF PREFERRED EMBODIMENT

Figure 2:
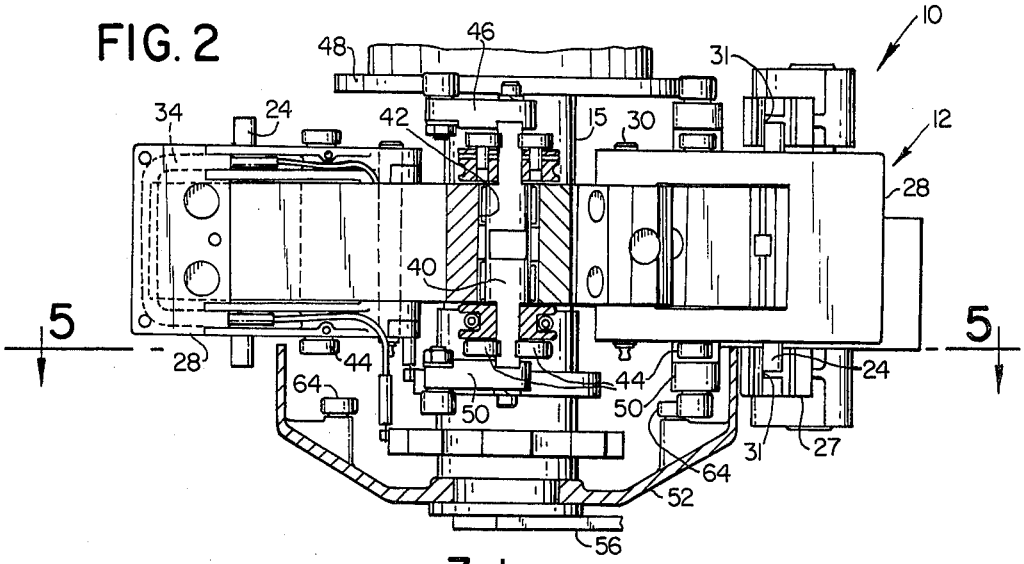
FIG. 2 is a sectional view taken generally along the line 2—2 of FIG. 1.
Figure 1:
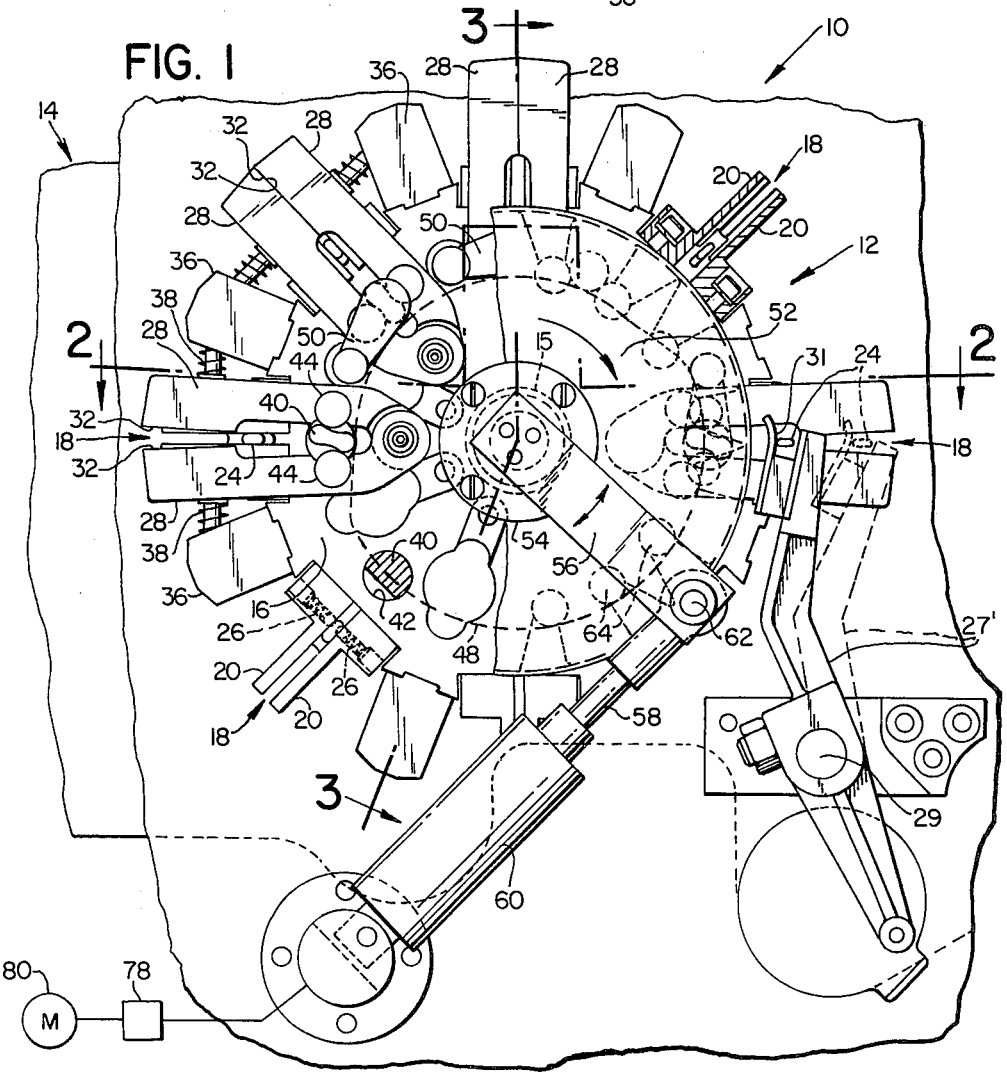
FIG. 1 is a front elevational view of a sealing wheel embodying the present invention with parts removed to expose structure therebehind.
Figure 3:
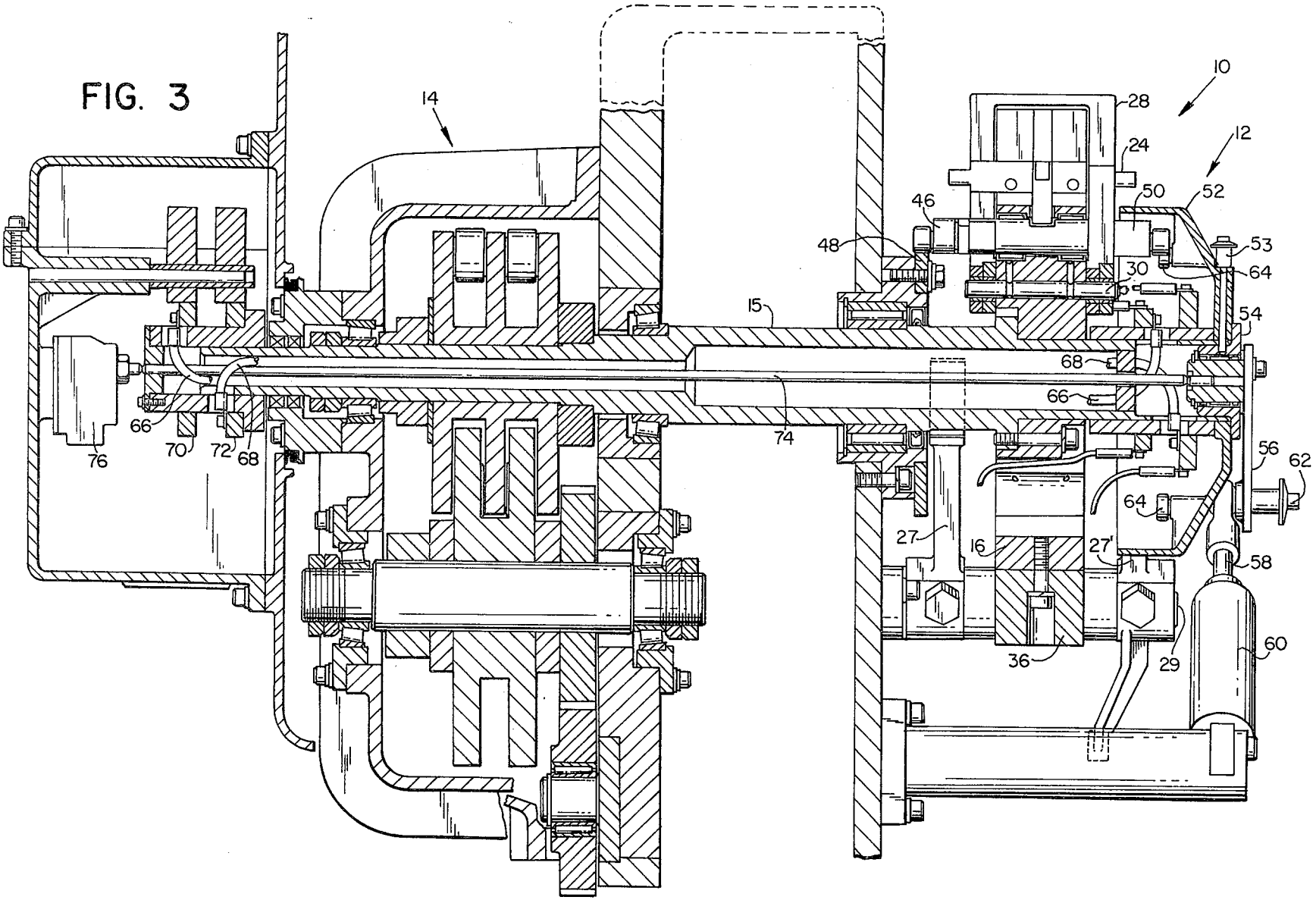
FIG. 3 is a sectional view through the sealing wheel taken generally along the line 3—3 of FIG. 1, the indexing drive unit shown rotated 90 degrees from its normal position.

Turning now to the drawings, a sealing wheel embodying the present invention and indicated generally by the reference numeral 10 in FIGS. 1–3 comprises a wheel assembly, indicated generally at 12, and a drive unit, designated generally by the reference numeral 14, which indexes the wheel assembly 12 about its axis of rotation. The illustrated sealing wheel 10 is particularly adapted to receive an article and its wrapper, form the wrapper around the article, and seal complementary marginal portions of the wrapper together in face-to-face relation beyond associated edges of the article whereby to form the generally rectangular package characterized by a fold line which extends along one side edge of the package and a generally U-shaped fin seal which defines the other three side edges of the package.

Figure 6:
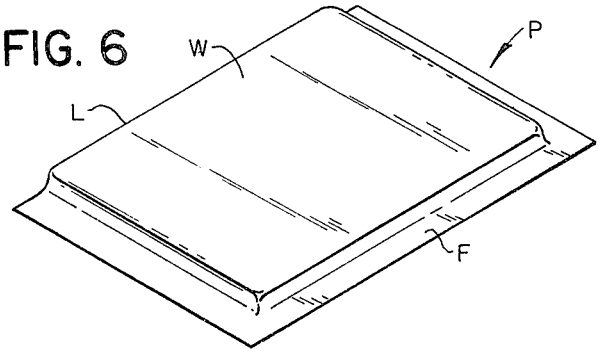
FIG. 6 is a perspective view of a package formed by the sealing wheel of the present invention.
Figure 7:
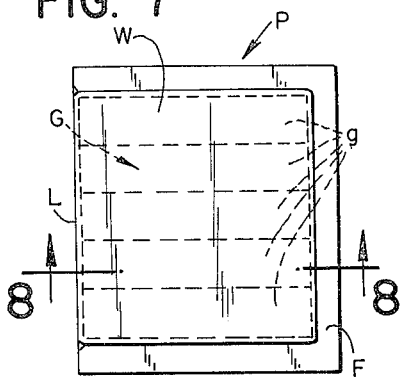
FIG. 7 is a plan view of the package shown in FIG. 6.
Figure 8:
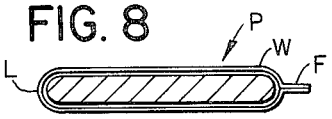
FIG. 8 is a sectional view taken along the line 8—8 of FIG. 7.
Figure 5:
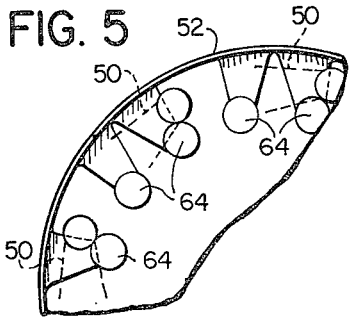
FIG. 5 is a fragmentary sectional view taken generally along the line 5—5 of FIG. 2.

Such a rectangular fin seal package is shown in FIGS. 6–8, indicated generally by the letter P, and is particularly suitable for containing gum or a like confection which requires a tightly sealed package for maximum shelf life. The package P may contain one or more articles, such as wrapped sticks of gum, indicated at g, g in FIG. 7, however, for convenience in the description which follows the gum sticks g, g will be designated collectively as an article and indicated by the letter G. The package P is made from a single sheet of heat sealable wrapping material, designated by the letter W and folded to a U-shape around the article G. The wrapper W has a fold line L adjacent one side of the article which defines one side edge of the package and complementary marginal portions which extend outwardly beyond the article G and which are sealed in face-to-face relation and form a generally U-shaped fin F which defines the remaining three side edges of the package P.

Figure 4:
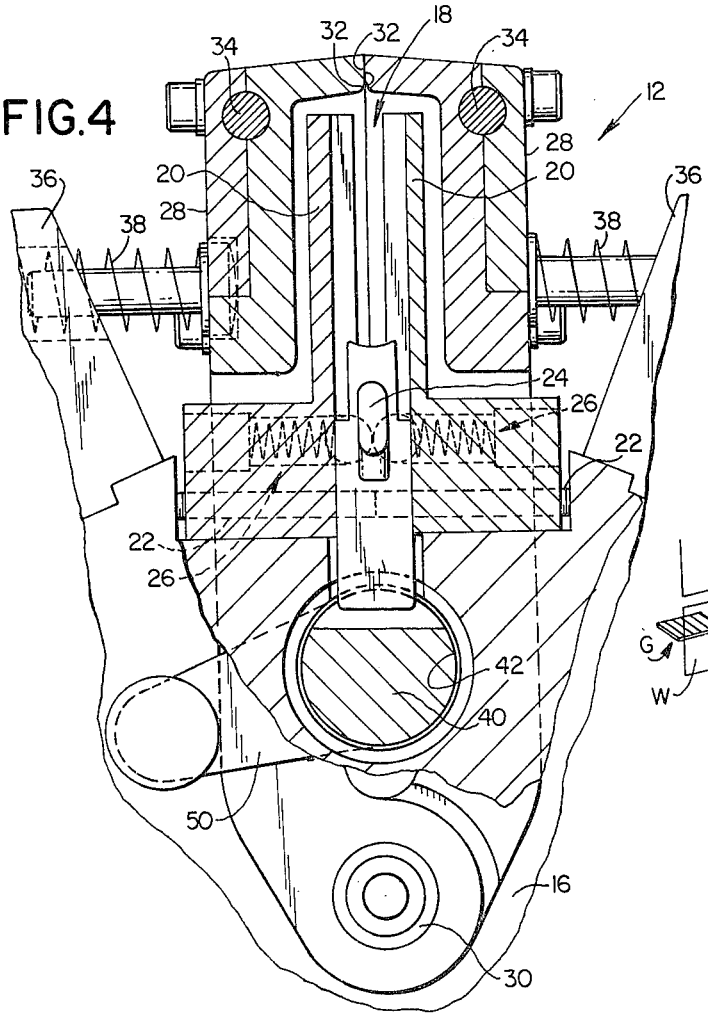
FIG. 4 is a somewhat enlarged fragmentary radial sectional view through the wheel assembly of FIG. 1.

Considering the machine 10 in further detail and referring now to FIGS. 1–4, the wheel assembly 12 is mounted in fixed position on a hollow drive shaft 15 for coaxial rotation with the shaft and includes a wheel body 16 and a plurality of equiangularly spaced pockets, indicated generally at 18, 18 in FIG. 1, for receiving articles G, G to be wrapped and the wrappers W, W. Referring more particularly to FIG. 4 each pocket 18 is defined by a pair of stationary jaws 20, 20 bolted in fixed position on the body 16, which forms the central portion of the wheel assembly. Abutting adjustment screws 22, 22 are provided for adjusting the pocket opening between each pair of stationary jaws 20, 20, substantially as shown. Each pocket 18 contains an elongated ejector element 24 which is supported in the pocket for sliding movement between receiving and ejecting positions. The opposite end portions of each ejector element 24 extend laterally outwardly for some distance beyond the wheel body 16, as best shown in FIGS. 2 and 3. Spring-ball detents indicated generally at 26, 26, and best shown in FIG. 4, cooperate to releasably retain each ejector element in its receiving position within its associated pocket 18. The ejector elements 24, 24 comprise part of an ejector mechanism which includes a pair of ejector levers 27, 27' mounted in fixed position on a rock shaft 29 at the inner and outer sides of the wheel assembly and at its discharge end. Each of the levers 27, 27' has a generally upwardly open channel 31 at its upper end for receiving an associated end portion of an ejector element 24 as will be hereinafter further discussed.

A pair of movable sealing jaws 28, 28, are supported on the wheel body 16 in association with each set of stationary jaws 20, 20. The sealing jaws 28, 28 of each set are substantially identical, have a generally U-shaped configuration and include legs which straddle the wheel body 16 and are attached to the body by a common pivot pin 30, which extends through the wheel body 16 in parallel relation to the drive shaft 15, as best shown in FIG. 3. Each sealing jaw 28 is recessed to receive an associated stationary jaw 20 therein when the sealing jaws 28, 28 are in closed position. Each pair of sealing jaws 28, 28 has opposing generally U-shaped sealing surfaces 32, 32. At least one of the sealing jaws 28 in each pair carries a heating element for heating its sealing surface, but preferably and as shown, each sealing jaw 28 carries an electrically operated heating element 34, as shown in FIGS. 2 and 4, which heats its sealing surface 32.

A reaction block 36 is mounted in fixed position on the wheel body 16 between each pair of sealing jaws 28, 28 and the next adjacent pair of sealing jaws in the series, substantially as shown in FIG. 1. Springs 38, 38 act between the reaction blocks 36, 36 and the jaws 28, 28 to bias the jaws 28, 28 of each pair toward normally closed position wherein the sealing surfaces 32, 32 of the jaws are engageable. A jaw opening mechanism hereinafter described is provided for opening each pair of sealing jaws 28, 28 at a predetermined angular position of the wheel assembly and in response to rotational movement of the wheel assembly. The opening mechanism is also arranged to simultaneously open all jaws 28, 28 which may be in closed position in response to occurrence of a predetermined condition, such as machine shut-down.

The jaw opening mechanism includes a jaw opener cam shaft 40 associated with each pair of sealing jaws 28, 28. Each cam shaft 40 is journalled in an associated bore 42 which extends transversely through the wheel body 16 in generally parallel relation to the drive shaft 15. The end portions of each opener cam shaft 40 extend outwardly in opposite directions between the legs of an associated pair of sealing jaws 28, 28 and for some distance therebeyond, as best shown in FIG. 2. Portions of each cam shaft 40 are shaped to engage and move roller followers 44, 44 mounted on the legs of each sealing jaw 28 when the opener cam shaft 40 is moved angularly within the wheel body 16. A jaw opener lever 46 mounted on the inner end of each cam shaft 40 carries a roller follower which engages a stationary cam 48 mounted in fixed position on the machine frame inwardly of the wheel assembly 12. A similar shut-down lever 50, which also carries a roller follower, is mounted at the outer end of each opener cam shaft 40.

The shut-down levers 50, 50 are operated by a shut-down member or angularly movable bell housing 52 mounted at the outer end of the wheel assembly 12. The bell housing 52 is supported for limited rotational movement on the outer end of the drive shaft 15 and is secured to the drive shaft by a ball lock pin 53 which extends through the bell housing and through an arcuate slot in the outer end of the drive shaft 15. The inner end of the pin 53 is engaged in the outer part of a sprag clutch 54 received in the outer end of the tubular drive shaft 15. The outer part of the one way clutch 54 is bolted to the bell housing 52, as best shown in FIG. 1. A radially outwardly extending crank arm 56 bolted to the inner part of the clutch 54 is secured to a movable part or piston rod 58 of a fluid motor or double acting pneumatic cylinder 60 by a ball lock pin 62.

On the inner side of the bell housing 52 there is mounted a circumaxially spaced series of sets of cam rollers 64, 64. Each set of rollers 64, 64 receives the roller follower of an associated shut-down lever 50 therebetween. The cam rollers 64, 64 are arranged to simultaneously impart angular movement to each shut-down lever 50 associated with a pair of sealing jaws 28, 28 which are in closed position to simultaneously move the latter jaws to open position when the bell housing is moved angularly about its central axis and relative to the wheel assembly 12 in response to operation of the fluid motor 60, as will be hereinafter further discussed.

The illustrated drive unit 14 is of a conventional type and will not be described in detail, however, the drive unit is connected to a suitable drive means (not shown) and provides a 45 degree index cycle for the illustrated 8 pocket wheel assembly 12. More specifically, the drive unit 14 advances the wheel assembly 12 in a clockwise direction and with a step-by-step 45 degree angular motion through a loading position, shown at 9 o'clock, and a discharging position, shown at 3 o'clock in FIG. 1. The drive unit 14 may be adjusted so that the wheel assembly 12 dwells for sufficient time at each angular position to allow an article and its wrapper to be inserted into a pocket 18 at the loading position and to permit a finished package to be ejected from a pocket 18 at the discharging position.

Electrical conduits 66 and 68 supply power to the heating elements 34, 34, are connected to the heating elements at the outer side of the wheel assembly 12, and are accessible for servicing upon removal of the bell housing. The conduits 66 and 68 extend through the hollow drive shaft 15 and are connected at the inner end of the shaft to slip rings 70 and 72 through which electrical power is supplied to the heaters. A safety interlock is provided for interrupting electrical power to the heating elements 34, 34 when the bell housing 52 is removed. The interlock comprises an elongated rod 74 which bears against the inner surface of the clutch 54 and extends through the hollow shaft 15 to maintain a normally open switch 76, located at the inner end of the machine, in closed contact condition. The switch 76 is connected in the heater circuit between the heaters 34, 34 and the electrical power supply source (not shown).

Figure 9:
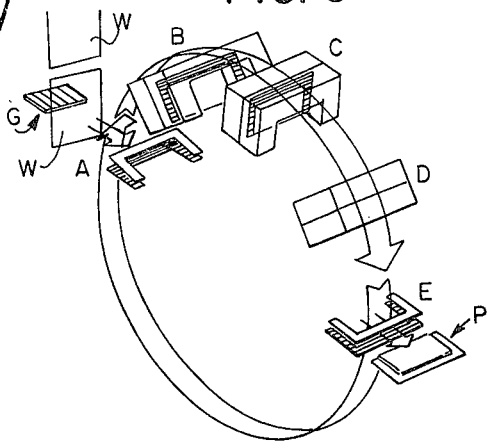
FIG. 9 is a somewhat schematic perspective view of the sealing wheel assembly.

Considering now the operation of the sealing wheel 10 and referring particularly to FIG. 9, wherein the wheel assembly 12 is illustrated somewhat schematically, wrapped gum sticks g, g to be packaged which comprise an article G, are accumulated in groups of five sticks arranged in adjacent side-by-side relation. The article G is advanced, by associated conveying means (not shown) toward and into a pocket 18 which is in dwell mode at the loading position. The latter position, for convenience of description, is designated position A. As each article G is fed into the pocket 18 at position A the article picks up a wrapper W which is folded around the article in a U-fold as the article and wrapper W enter the pocket 18. The sealing jaws 28, 28 associated with the pocket at position A are, of course, in open position and the ejector element 24 associated with the latter pocket is in its receiving position, being held in receiving position by associated spring-ball detents 26, 26.

As the wheel assembly indexes through a 45 degree cycle in a clockwise direction to position B of FIG. 9, the jaw opener lever 46 associated with the movable sealing jaws 28, 28 cooperates with the stationary cam 48 to allow the sealing jaws to close under the biasing force of springs 38, 38. The U-shaped sealing surfaces 32, 32 engage associated marginal portions of the wrapper W which extend outwardly beyond the pocket 18 defined by associated stationary jaws 20, 20. The sealing jaws remain closed during more than three indexing cycles or for more than 135 degrees of wheel assembly rotation, that is while the pocket 18 is indexed from position A through positions B, C and D. This arrangement allows ample time for the sealing jaws to apply sufficient heat to the wrapper marginal portions to produce a satisfactory fin seal.

As a pocket 18 approaches the wheel assembly discharging or unloading position, designated by the letter E, diametrically opposite the loading position A, an associated jaw opener lever 46 cooperates with the stationary cam 48 to angularly move the jaw opener cam shaft 40 and thereby open the sealing jaws 28, 28. As the pocket 18 moves into the unloading position (position E) end portions of the associated ejector element 24 enter the channels 31, 31 in the ejector levers 27, 27'. While the pocket 18 dewells at unloading position E the ejector levers 27, 27' which operate in timed relation to the indexing drive mechanism 14 move from the full line or receiving position to the broken line or ejecting position of FIG. 1 to move the ejector lever 24 to its ejecting position thereby discharging a finished package P from the sealing wheel 10. The return movement of the ejector levers 27, 27' returns the ejector element to its receiving position wherein it is releasably retained by associated spring-ball detents 26, 26. Thereafter, the sealing wheel 10 is indexed through the next 45 degree indexing cycle and the aforedescribed sequence of operations is repeated.

In the event of a jam or other predetermined condition which results in interruption of the cyclical operation of the sealing wheel 10 the jaw opener mechanism operates to simultaneously open each sealing jaw 28 which may then be in closed position. This arrangement prevents application of excessive heat to an article G which may cause the article to melt within its associated pocket 18.

The illustrated machine 10, has a sensing device, illustrated schematically and indicated by the numeral 78 in FIG. 1, for detecting interruption of the cyclical movement of the sealing wheel. The sensing device 78 may, for example, detect interruption of power to a drive motor, such as the motor 80, which is illustrated schematically in FIG. 1 and which drives the sealing wheel 10. The sensing device preferably includes a timing mechanism for energizing the pneumatic cylinder 60 only if the power interruption exist for more than a predetermined interval of time.

Upon occurrence of such a predetermined condition, the wheel assembly will, of course, be at rest and the sealing jaws 28, 28 associated with the pockets 18, 18 on the upper portion of the wheel assembly at or near positions B, C and D will normally be closed or in heat sealing condition. Upon detection of the predetermined condition the pneumatic cylinder 60 is energized by operation of an associated control valve (not shown) and moves the lever 56 in a clockwise direction from its position of FIG. 1 causing the outer part of the clutch 54 to move with the inner part and, in turn, causing the bell housing 52 to move angularly in clockwise direction and relative to the wheel body 16. Angular movement of the bell housing is or may be limited by travel of the pin 53 within an associated slot in the drive shaft. This angular movement of the bell housing causes cam rollers 64, 64 carried by the bell housing to engage and move the shut-down levers 50, 50 associated with the closed sealing jaws 28, 28 at or near positions B, C and D to move the latter sealing jaws to open position. The various sealing jaws will remain open for as long as the predetermined condition exists. Since the products within the pockets are held by the stationary jaws 20, 20 the heat sealing jaws 28, 28 will be out of engagement with the wrappers W, W while the latter jaws are in open position.

When the condition which caused shut-down has been corrected and the apparatus is again started the pneumatic cylinder 58 operates to move the bell housing 52 in a counterclockwise direction relative to the wheel body thereby removing the influence of the cam roller 64, 64 on the various shut-down levers so that further opening and closing movements of the sealing jaws are thereafter controlled by the stationary cam 48.

The bell housing assembly which includes the bell housing 52, the clutch 54 and the crank arm 56 may be rapidly removed from the wheel assembly to facilitate lubrication and maintenance of the wheel assembly by pulling the lock pins 53 and 62. When the bell housing assembly is removed the rod 74 allows the switch 76 to assume an open circuit condition whereby power to the sealing jaw heaters 34, 34 is interrupted. A single switch 76 is shown, for clarity of illustration, however, it should be understood that multiple safety interlock switches, as aforedescribed, may be provided to further reduce risk of electrical shock when the bell housing is removed.

Figure 11:
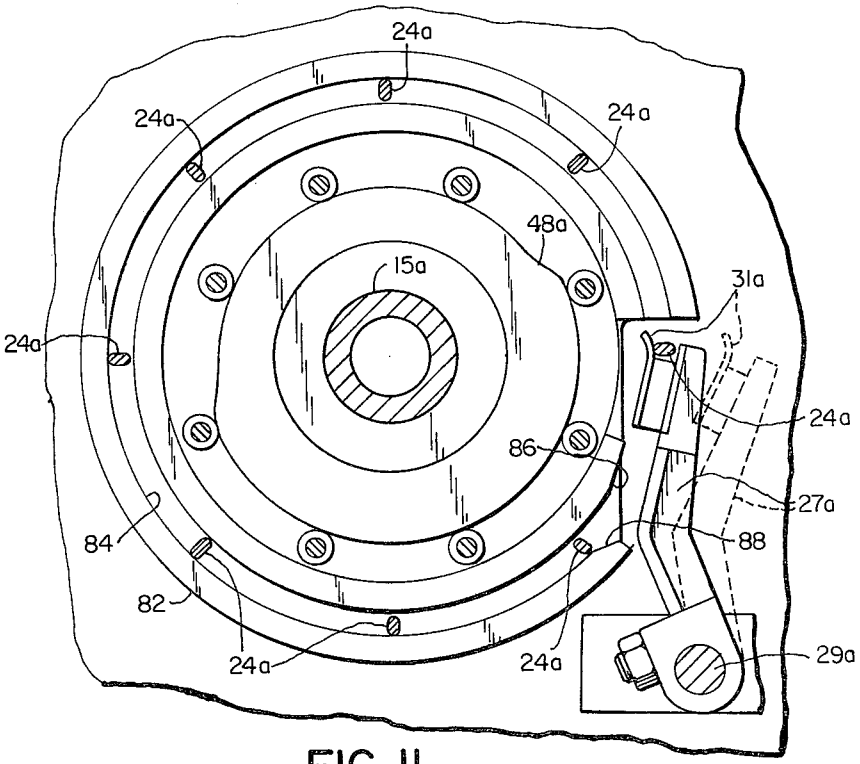
FIG. 11 is a fragmentary sectional view taken along the line 11—11 of FIG. 10.
Figure 10:
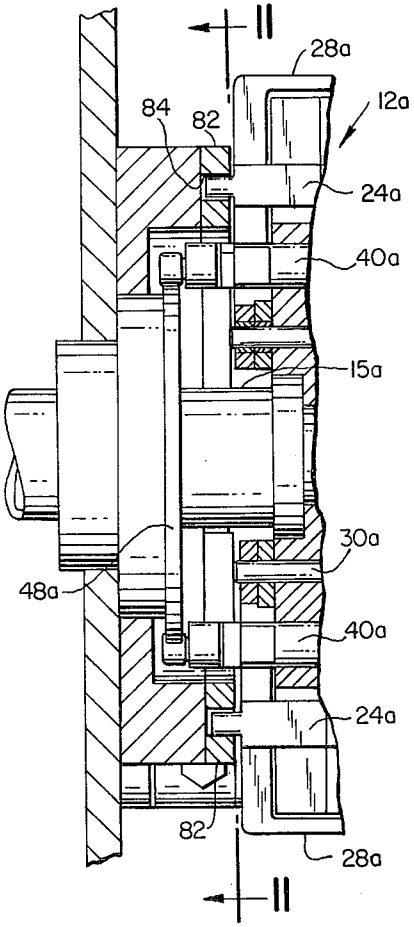
FIG. 10 is a fragmentary sectional view similar to FIG. 3, but illustrates another embodiment of the invention.

Referring now to FIGS. 10 and 11, another wheel assembly embodying the invention is indicated generally at **12*a*. The wheel assembly 12*a* is similar in most respects to the wheel assembly 12, previously described, but differs therefrom in the arrangement for retaining each ejector element in its receiving position within its associated pocket. Parts of the sealing wheel 12*a*, substantially identical to parts of the previously discussed wheel assembly 12**, bear the same reference numeral as the corresponding parts previously described and a letter a suffix will not be hereinafter further described in detail.

The wheel assembly **12*a* has a generally annular ejector element retaining ring 82 which is bolted in fixed position to the machine frame inwardly of and in coaxial alignment with the drive shaft 15*a*, as best shown in FIG. 11. The retaining ring 82 cooperates with the ejector lever 27*a* and has a parti-circular outwardly opening track 84 for receiving inner end portions of the ejector elements 24*a*, 24*a* and for retaining the latter elements in receiving position. The track 84 has a gap or break at the three o'clock position, as shown in FIG. 11, to provide clearance for an associated ejector lever 27*a*. Diverging guide surfaces 86 and 88 define the entry end of the track 84, substantially as shown. When the ejector levers 27*a*, 27*a'* are in receiving position the channel 31*a* on the lever 27*a* is aligned with the track 84, as shown in FIG. 11, where the receiving position of the ejector lever 27***a* is shown in full lines. It should be noted that the inner end portion of the ejector element 24*a* at the discharging or three o'clock position is disposed within the channel 31*a* whereas the inner end portions of each of the other ejector elements 24, 24 are disposed within the track 84.

While the wheel assembly 12*a* is at rest the ejector levers 27*a* and 27*a* operate to move the ejector element 24*a* at the discharging position from its receiving to its ejecting position and to return it to its receiving position. Thereafter, the sealing wheel 12*a* indexes in a clockwise direction. The ejector lever 27*a* remains in its receiving or full line position of FIG. 11 during this indexing movement of the wheel assembly 12*a*. The arm of the lever 27*a* is disposed in the path of the ejector element 24*a*, after it leaves the channel 31*a*, and prevents the latter element from moving radially outwardly and out of its respective pocket 18*a* (not shown) as the wheel assembly moves the latter ejecting element across the gap in the track 84 to the four o'clock position in FIG. 11, where it reenters the track 84. The guide surfaces 86 and 88 assure proper reentry. It will now be apparent that the ring 82 may be used in place of the various spring-ball detents 26, 26 to retain the ejector elements in receiving position within their respectively associated pockets while the wheel assembly is indexed through its various positions.

We claim:

1. A sealing wheel comprising a wheel assembly, and drive means for rotatably indexing said wheel assembly through a plurality of positions including an article loading position and article discharging position, said wheel assembly including a wheel body, stationary jaw means on said wheel body defining at least one radially outwardly opening pocket for receiving an article and its wrapper and forming the wrapper in a U-fold around the article when said one pocket is in said loading position and including a pair of stationary jaws mounted in fixed position relative to said wheel body and having opposing parallel jaw surfaces defining said pocket, a pair of opposing sealing jaws pivotally supported on said wheel body in association with said one pocket for movement between open and closed positions, each of said sealing jaws being supported for movement relative to the wheel body and having a recess within which an associated one of said stationary jaws is received and surrounded on three sides by said sealing jaws when said sealing jaws are in closed position, said sealing jaws having opposing generally U-shaped sealing surfaces on said three sides for sealing said folded wrapper on three sides of said article, said stationary jaws positioned to maintain in spaced relation to said sealing surfaces marginal portions of a wrapper contained within and extending outwardly beyond the confines of said pocket when said sealing jaws are in said open position, said sealing surfaces being engageable with the extending marginal portions of the wrapper when said sealing jaws are in closed position, means for heating at least one of said sealing surfaces, means for normally biasing said sealing jaws toward said closed position and means for opening said sealing jaws when said sealing wheel is indexed to a predetermined position by said drive means and including a cam shaft supported on said wheel body between said sealing jaws for angular movement about its axis, said cam shaft and said jaws having coengageable cam surfaces for simultaneously pivoting said sealing jaws away from said stationary jaws and each other in response to angular movement of said cam shaft about its axis, a stationary cam, and an opener lever attached to said cam shaft and engaged with said stationary cam for angularly moving said cam shaft when said sealing wheel is indexed to said predetermined position.

2. A sealing wheel as set forth in claim 1 wherein said sealing jaws comprise generally U-shaped jaws straddling said stationary jaws.

3. A sealing wheel as set forth in claim 2 wherein said sealing jaws straddle at least a portion of said wheel body and are supported on said wheel body for pivotal movement about a common axis parallel to the axis of rotation of said wheel assembly.

4. A sealing wheel as set forth in claim 1 wherein said sealing wheel includes ejecting means for moving an article and its wrapper out of said pocket when said pocket is in said discharging position.

5. A sealing wheel as set forth in claim 4 wherein said ejecting means includes an ejector element supported within said one pocket for movement between receiving and ejecting positions, means for releasably retaining said ejector element in said receiving position and means for moving said ejector element between said receiving and ejecting positions when said one pocket is in said discharging position.

6. A sealing wheel as set forth in claim 5 wherein said means for releasably retaining said ejector element comprises a ball detent mechanism.

7. A sealing wheel as set forth in claim 5 wherein said means for releasably retaining said ejector element comprises a stationary track for receiving an associated portion of each of said ejector elements therein.

8. A sealing wheel as set forth in claim 7 wherein said track comprises a parti-circular track.

9. A sealing wheel as set forth in claim 1 wherein said drive means includes a tubular drive shaft supporting said wheel assembly and said heating means comprises an electrically operated heating element electrically connected to a power source by conduits extending through said tubular drive shaft.

10. A sealing wheel as set forth in claim 9 wherein said wheel assembly includes a housing assembly releasably connected to said drive shaft and interlock means for disabling said heating element when said housing assembly is removed from said drive shaft.

11. A sealing wheel as set forth in claim 10 wherein said housing assembly is connected to one end of said drive shaft and said interlock means includes an electrical switch at the other end of said drive shaft and a rod extending through said drive shaft and bearing against said housing assembly and an actuator on said switch to maintain said switch in closed circuit condition while said housing assembly is retained on said drive shaft.

12. A sealing wheel as set forth in claim 1 wherein said wheel assembly includes a plurality of pairs of stationary jaws defining a plurality of angularly spaced pockets, a plurality of pairs of movable sealing jaws, each pair of sealing jaws cooperating with an associated pair of stationary jaws, and jaw operating means for simultaneously moving all of said sealing jaws from said closed position to said open position.

13. A sealing wheel as set forth in claim 12 wherein said sealing wheel includes sensing means for detecting occurrence of a predetermined sealing wheel operating condition and means responsive to said sensing means for actuating said jaw operating means upon detection of said predetermined condition by said sensing means.

14. A sealing wheel as set forth in claim 4 wherein said ejecting means comprises an ejector element supported within said one pocket for movement relative to said one pocket between article receiving and article ejecting positions and having an end portion projecting from said one pocket, means defining a parti-circular track coaxially aligned with said wheel body for receiving said end portion when said ejector element is in its article receiving position to retain said ejector element in its article receiving position as said sealing wheel is rotatably indexed to and from said discharging position, said track having a gap at said article discharging position, and an ejector lever operable in timed relation to said drive means and movable into and out of said gap for moving said ejector element between said article receiving and article ejecting positions, said ejector lever having a channel movable into and out of alignment with said track for receiving said end portion when said one pocket is in said article discharging position and moving said ejector element between its article receiving and article ejecting positions.

15. A sealing wheel comprising a wheel assembly, and drive means for rotatably indexing said wheel assembly through a plurality of positions including an article loading position and an article discharging position, said wheel assembly including a wheel body, stationary jaw means on said wheel body defining at least one radially outwardly opening pocket for receiving an article and its wrapper and forming the wrapper in a U-fold around the article when said one pocket is in said loading position and including a pair of stationary jaws mounted in fixed position relative to said wheel body and having opposing parallel jaw surfaces defining said pocket, a pair of opposing sealing jaws supported on said wheel body in association with said one pocket for movement relative to said wheel body between open and closed positions, each of said sealing jaws being supported for movement relative to the wheel body and having a recess within which an associated one of said stationary jaws is received and surrounded on three sides by said sealing jaws when said sealing jaws are in closed position, said sealing jaws having opposing generally U-shaped sealing surfaces on said three sides for sealing said folded wrapper on three sides of said article, said stationary jaws positioned to maintain in spaced relation to said sealing surfaces marginal portions of a wrapper contained within and extending outwardly beyond the confines of said pocket when said sealing jaws are in said open position, said sealing surfaces being engageable with the extending marginal portions of the wrapper when said sealing jaws are in closed position, means for heating at least one of said sealing surfaces, means for opening and closing said sealing jaws, and ejecting means for moving an article and its wrapper out of said one pocket when said one pocket is in said discharging position and including an ejector element supported within said one pocket for movement relative to said one pocket between article receiving and article ejecting positions and having an end portion projecting from said one pocket, means defining a parti-circular track coaxially aligned with said wheel body for receiving said end portion when said ejector element is in its article receiving position to retain said ejector element in its article receiving position as said sealing wheel is rotatably indexed to and from said discharging position, said track having a gap at said article discharging position, and an ejector lever operable in timed relation to said drive means and movable into and out of said gap for moving said ejector element between said article receiving and article ejecting positions, said ejector lever having a channel movable into and out of alignment with said track for receiving said end portion when said one pocket is in said article discharging position and moving said ejector element between its article receiving and article ejecting positions.

* * * * *